United States Patent [19]

Gilson

[11] Patent Number: 4,926,299

[45] Date of Patent: May 15, 1990

[54] PORTABLE FLASHLIGHT

[76] Inventor: Warren E. Gilson, 601 N. Segoe Rd., Unit #104, Madison, Wis. 53705

[21] Appl. No.: 358,425

[22] Filed: May 30, 1989

[51] Int. Cl.[5] ..... F21L 7/00

[52] U.S. Cl. ..... 362/184; 362/186; 362/190; 362/200; 362/205

[58] Field of Search ..... 380/433; 200/60; 362/157, 184, 186, 190, 191, 200, 205

[56] References Cited

U.S. PATENT DOCUMENTS

| | | | |
|---|---|---|---|
| 1,230,304 | 6/1917 | Kiernan | 362/284 |
| 1,274,713 | 8/1918 | Hoffmann et al. | 362/200 |
| 1,621,955 | 3/1927 | Schiffner | 362/187 |
| 1,747,754 | 2/1930 | Craig | 362/284 |
| 1,767,756 | 6/1930 | Hall | 362/284 |
| 1,850,103 | 3/1932 | Hall | 362/268 |
| 4,432,043 | 2/1984 | Yuen | 362/184 |
| 4,456,948 | 6/1984 | Brun | 362/268 |
| 4,605,994 | 8/1986 | Krieg | 362/187 |
| 4,638,414 | 1/1987 | de Vos et al. | 362/370 |

*Primary Examiner*—Ira S. Lazarus
*Assistant Examiner*—Sue Hagarman
*Attorney, Agent, or Firm*—Mason, Kolehmainen, Rathburn & Wyss

[57] ABSTRACT

A battery powered flashlight includes a case holding a battery, lamp, reflector and an electric circuit including switch means for connecting and disconnecting the battery to selectively energize and turn off the lamp. The flashlight includes a lens supported adjacent an end or side of the case in front of the lamp and reflector forming a rectangular beam of light when the lamp is energized for providing a non-glare illumination of a relatively small rectangular area such as along a sidewalk or a stair tread. The flashlight may also include a second lamp and reflector at an opposite end of the case providing a spotlight and a switch for selecting between the spotlight and the area illuminating beam. The flashlight may include a carrying handle in the form of a bail which acts to operate the switch for initiating the rectangular beam of light or alternatively the spotlight. When the handle is in an open or carrying condition for supporting the flashlight, the case depends downwardly therefrom and when the handle is in a closed position portions of the handle provide protective covers for each of the lens and lamp combinations while the flashlight is not in use.

28 Claims, 3 Drawing Sheets

FIG. 1
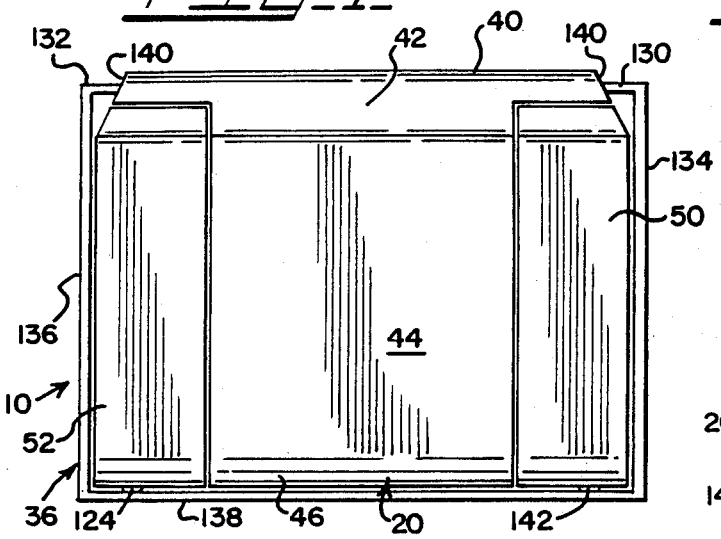
FIG. 2
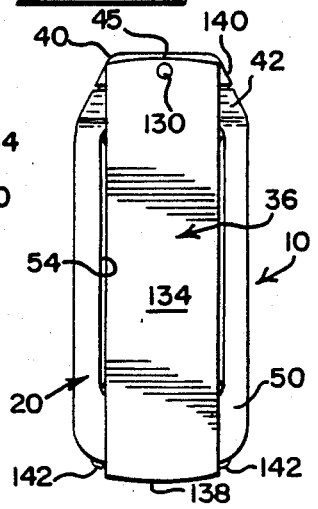
FIG. 3
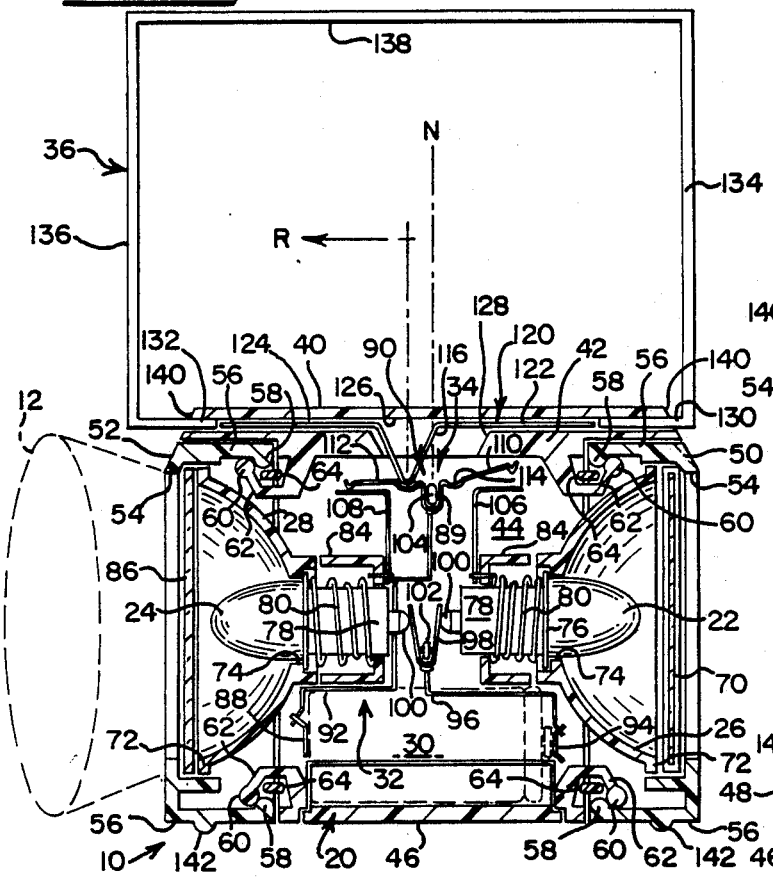
FIG. 4

PORTABLE FLASHLIGHT

BACKGROUND OF THE INVENTION

1. Field of the Invention

The present invention relates to battery powered flashlights and more particularly to a flashlight having a case and a lens at one end of the case for forming a generally rectangular cross-sectioned beam for generally illuminating an area without the glare of a spotlight when a handle of the flashlight is opened up to an operative position both for carrying the flashlight and for energizing a lamp therein. More particularly, a flashlight in accordance with the present invention provides a dual purpose light having a spotlight function, an area illumination function and a system for selecting these functions which is controlled by a switch activated by the position of a carrying handle. Another unique feature of the flashlight is the provision of a bail type carrying handle which also functions to turn off and on a single or selected lamp in the flashlight and, in addition, provides a protective covering therefor when the lamps are not illuminated.

2. Background of the Prior Art

The following U.S. patents disclose a variety of flashlights, spotlights, illuminating and flood lamps and other light producing systems and British Patent No. 104,847 (accepted Mar. 22, 1917) discloses an improved electric battery lamp:

| INVENTOR | PATENT NO. |
|---|---|
| Kiernan | 1,230,304 |
| Hoffman et al | 1,274,713 |
| Schiffner | 1,621,955 |
| Craig | 1,747,754 |
| Hall | 1,767,756 |
| Hall | 1,850,103 |
| Yuen | 4,432,043 |
| Brun | 4,456,948 |
| Krieg | 4,605,994 |

Of the aforementioned patents, none disclose a portable, battery powered flashlight employing a lens formed in a chordal segment of a cylinder or a similar Fresnel lens which generates a generally rectangular cross-sectional beam for generally illuminating a rectangular area or a combination type flashlight wherein both a spotlight and a rectangular beam are selectively available for use in illuminating a small area or spot with high intensity light or a larger area such as a stair or walkway with a non-glaring more uniform light pattern of rectangular shape for aid in walking or area searching. Moreover, none of the aforementioned patents teach or disclose the concept of a portable flashlight having a bail type carrying handle which activates a switch for turning on a lamp and subsequently turning off the lamp when the handle is moved to a closing position wherein portions of the handle serve as protective covers for the lamps and associated lens.

OBJECTS OF THE INVENTION

Accordingly, it is an object of the present invention to provide a new and improved battery powered flashlight having a lens adapted to generate a generally rectangular shaped beam of light for illuminating areas generally without intense glare.

Another object of the invention is to provide a portable flashlight of the character described having a dual function including a pair of lamps and lenses for generating a rectangular beam for area illumination and a spot of intense light for illuminating a smaller area or spot.

Another object of the present invention is to provide a new and improved portable flashlight of the character described which is provided with a unique bail type carrying handle which activates one or more switches in the flashlight to turn on and turn off lamps when in an open position and which in a dual capacity also covers or shields the lamps when the handle is in a closed position.

Yet another object of the present invention is to provide a new and improved flashlight of the character described which can be conveniently carried in a garment pocket and which can also be utilized to generally illuminate an area while sitting upright on a surface of a table, floor, etc.

Another object of the present invention is to provide a new and improved flashlight of the character described which is especially suited for use by a handicapped person in that a bail type handle is provided to activate a switch for energizing a lamp and once the lamp is on, the flashlight can be easily supported for carrying on a bent or crippled finger of a handicapped user.

Still another object of the present invention is to provide a new and improved flashlight of the character described wherein a carrying handle is operable to selectively switch between a pair of lamps used for producing either an intense spotlight type illumination or a relatively uniformly distributed lower intensity light beam of rectangular cross-section for area illumination.

Still another object of the present invention is to provide a new and improved flashlight of the character described which is relatively low in cost, easy to service and easy to use for a variety of different purposes such as for checking out a walking area or path without requiring a continuing lateral scanning motion and for sharply illuminating a relatively small area with a spot of intense light.

Yet another object of the present invention is to provide a new and improved flashlight having a higher optical efficiency than typical theatrical spotlights having "barn door" type, opaque shielding.

Still another object of the present invention is to provide a new and improved flashlight of the character described which is highly efficient in operation and which is capable of providing a suitably shaped light beam without extensive losses of light from the available energy of an illuminated lamp.

BRIEF SUMMARY OF THE INVENTION

The foregoing and other objects and advantages of the present invention are accomplished in a new and improved battery powered flashlight including a case holding a battery, a lamp, a reflector for the lamp and an electric circuit which includes a switch for connecting and disconnecting the battery to selectively turn on and turn off the lamp. A lens is supported at an end of the flashlight case in front of the lamp and reflector and is shaped like a chordal segment of a cylinder to form a rectangular cross-sectioned beam of light for generally illuminating a rectangular area ahead of the flashlight when the lamp is turned on by movement of a carrying handle into a supporting or carrying position with the case of the flashlight depending therebelow. A dual purpose flashlight is also provided with a second lamp and reflector at an opposite end of the case (or elsewhere) for producing a conventional high intensity spotlight when the second lamp is selectively switched on by appropriate movement of the carrying handle. The flashlight is thus capable of serving a dual purpose function in providing an intense spotlight and a less intense, more evenly illuminated light pattern of generally rectangular shape for illuminating stairs, a walking path, etc.

Another feature of the present invention is the novel use of a bail type handle which functions both to switch the lamp or lamps on and off and which additionally serves to cover the lamps and lenses when not turned on to protect the lamps, reflectors and lenses from damage.

BRIEF DESCRIPTION OF THE DRAWING

For a better understanding of the present invention, reference should be had to the following detailed description taken in conjunction with the drawings, in which:

FIG. 1 is a side elevational view of a new and improved battery powered flashlight constructed in accordance with the features of the present invention and illustrated with a carrying handle in an "off" position for protecting a lens, reflector and lamp of the flashlight;

FIG. 2 is an end elevational view of the flashlight of FIG. 1;

FIG. 3 is a longitudinal cross-sectional view of the flashlight of FIG. 1 illustrating a bail type carrying handle thereof in an upwardly extending, "on" position for carrying the flashlight and for selectively turning on one of the lamps thereof;

FIG. 4 is an end elevational view of the flashlight in an "on" or operative position with a lower portion illustrated in phantom to show a system for removing and replacement of a flashlight battery in the case of the flashlight;

FIG. 5 is an exploded, elevational sectional view of the flashlight similar to FIG. 3 and illustrating several of the components or systems thereof in a position separate and apart from a main body portion and illustrating the flashlight with the handle in an operative position wherein neither of the lamps is turned on;

FIG. 7 is a longitudinal cross-sectional elevational view of another embodiment of a flashlight in accordance with the features of the present invention employing only a single lamp and a lens shaped like a chordal segment of a cylinder for generating a rectangular cross-sectioned beam when the lamp is turned on.

DETAILED DESCRIPTION OF PREFERRED EMBODIMENTS OF THE INVENTION

Figure 5:
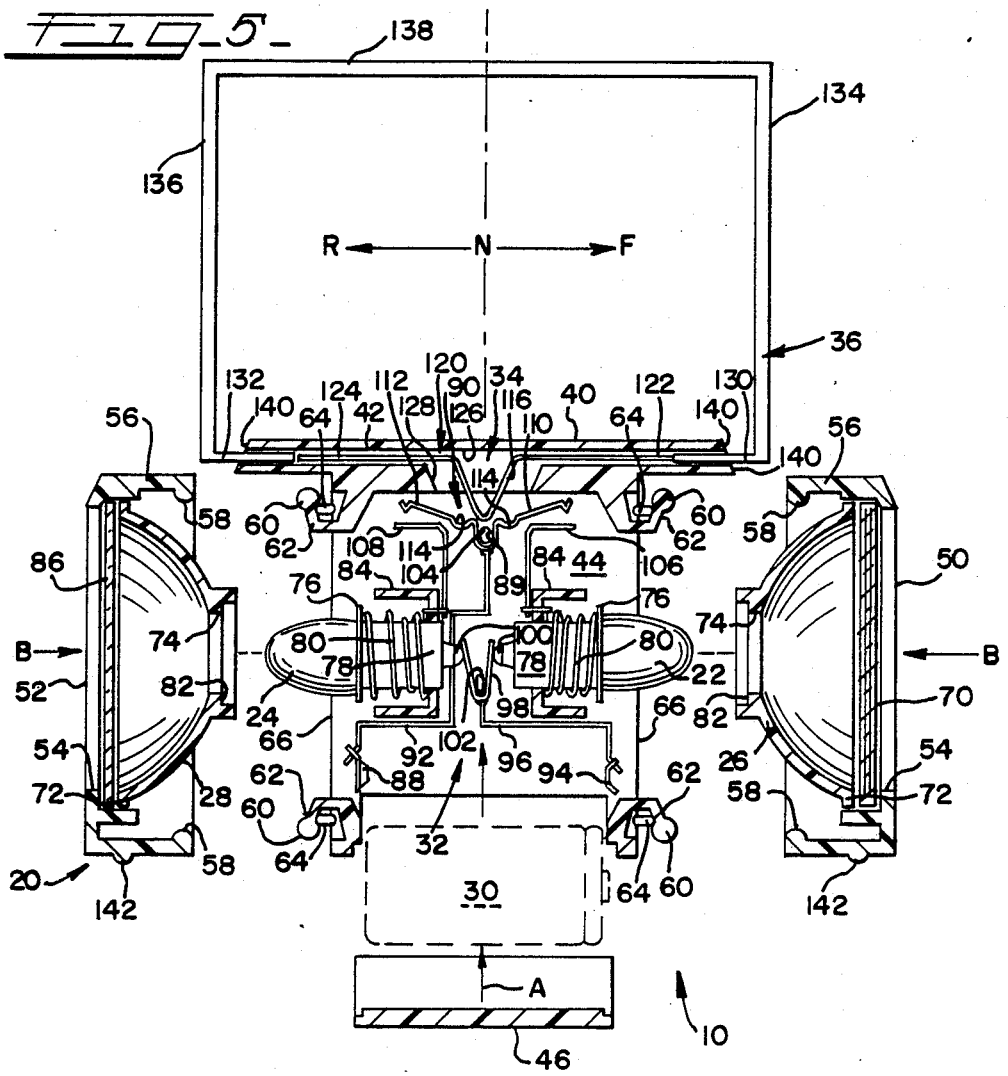

Referring now more particularly to the drawings, in FIGS. 1 through 6 is illustrated a new and improved dual function flashlight constructed in accordance with the features of the present invention and referred to generally by the reference numeral 10. In one mode of operation, the flashlight 10 functions as a spotlight when energized to generate a narrow beam of light 12 of relatively high intensity and having a generally circular or oval transverse cross-section for use in illuminating small objects with a high degree of intensity. In a second mode of operation, the flashlight 10 generates a beam of light 14 having a transverse cross-section of generally rectangular shape and having lower intensity for illuminating a larger area 16 of generally rectangular shape such as an area along a stair, sidewalk, walkway or path, etc.

In accordance with the present invention, the dual function flashlight 10 includes a body or case 20 of generally rectangular shape which contains a pair of lamps 22 and 24 facing opposite one another, each lamp being associated with a concave reflector 26 and 28, respectively. Electricity for energizing the lamps is provided by a battery 30 mounted in a lower portion of the case between the reflectors 26 and 28. The flashlight includes an electrical circuit generally indicated by the reference numeral 32 for supplying power from the battery 30 to energize the respective lamps 22 and 24 and the circuit includes a switch assembly 34 which is actuated by a carrying handle 36 pivotally secured to an upper portion of the case 20 for movement between a closed, lens covering position, FIGS. 1 and 2, for turning the lamps 22 and 24 off and an upstanding, "on" or operative carrying position, FIGS. 3, 4 and 5, for supporting the flashlight with the body 20 bending therefrom. Preferably, the body or case 20, and the reflectors 26 and 28 are formed of molded plastic material in an injection molding process to provide both a neat appearance and a relatively low cost for the flashlight 10.

In accordance with the present invention, the plastic body or case 20 of the flashlight includes a main central section 40 comprising a relatively thick top wall 42 and a pair of downwardly extending, opposite side walls 44 integrally joined therewith. Preferably, the central body section 40 is formed in two identical halves which are permanently joined together and each of which includes a portion of the top wall 42 and one of the side walls 44. The halves are joined along a central longitudinally extending joint line 45 (FIG. 2) by appropriate means such as adhesives, suitable interlocking protrusions, catches, latches, or the like.

At the lower end, opposite side walls 44 of the body are open and an opening formed thereby is closed by a detachable bottom wall section 46 which snaps into place on upward movement as indicated by the arrows "A" in FIGS. 4 and 5. It should be noted from FIG. 4, that the longitudinally extending bottom wall 46 has a U-shaped transverse cross-section and has retaining ridges 48 formed along opposite, upper, longitudinal edges of flexible side walls to snap into place with cooperating ridges formed on lower edge portions of the opposite side walls 44 of the body central section 40. The bottom wall 46 is removable from the enclosing position of FIG. 3 to the position shown in FIGS. 4 and 5 for permitting the battery 30 to be inserted into position or removed and replaced from time to time as necessary.

The case and body 20 also includes a pair of end frames 50 and 52 of identical construction adapted to snap into place at opposite ends of the case (as shown in FIGS. 3 and 5) by inward movement as illustrated by arrows "B" in FIG. 5. Each end frame 50, 52 is formed of molded plastic material similar to that used for the main body section 40 and the bottom wall section 46, and both end frames include an outer end wall having a large, generally rectangular opening 54 for the passage of light outwardly from the bulbs 22 and 24 and their respective reflectors 26 and 28. In addition, each end frame 50 and 52 includes an inwardly projecting, annular peripheral side wall 56 having an inwardly directed peripheral rib 58 on an inner end thereof adapted to snap into engagement with upper and lower ribs 60 formed on the central body section 40 as best shown in FIGS. 3 and 5.

The upper and lower retaining ribs 60 have a generally circular transverse cross-section and are integrally formed on the outer end of deflectable fingers 62. Each pair of upper and lower deflectable fingers 62 formed at an end of the case 20 is adapted to be deflected inwardly towards a lamp 22 or 24 when a respective end wall frame 50 or 52 is snapped inwardly into place by movement in the direction of the arrows "B" (FIG. 5). Fixed, transverse cross members 64 extending between the opposite sidewalls 44 serve to limit and direct the movement of flexible fingers 62. Once the retaining ribs 58 on the respective end wall frames 50 and 52 move past the retainers 60 on the fingers 62, the frames are positively retained in place (FIG. 3) by continuing engagement between the fixed ribs 58 and the flexible retaining ribs 60 as illustrated in FIG. 3. Referring to FIG. 5, before assembly of the end frames 50 and 52 onto the central body section 40, the deflectable fingers 62 and the ribs 60 at the outer ends thereof are in an outwardly projecting position as illustrated. Upon insertion of the end frames 50 and 52, the fingers 62 and retainers 60 are forced inwardly, but not backwardly, by the ribs 58 on the end frames and this engagement is retained continuously until inner end faces of the frames 50 and 52 abut against stop surfaces 66 on opposite ends of the main body side walls 44.

Figure 6:
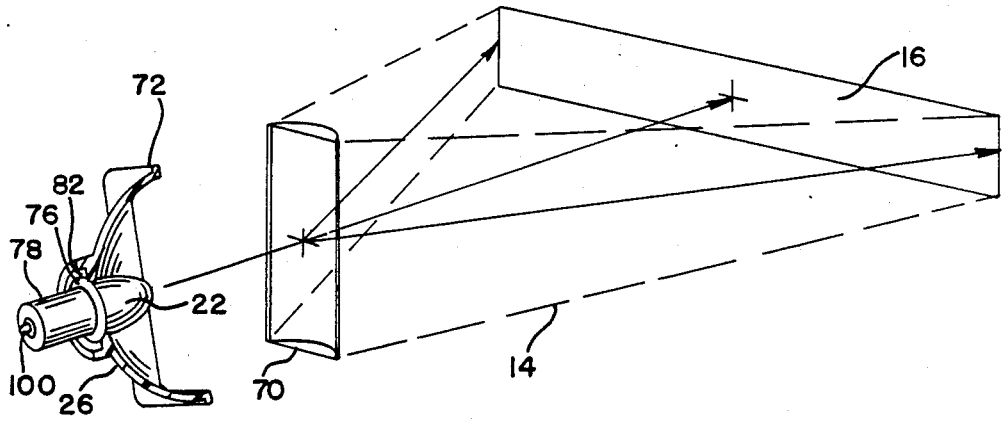
FIG. 6 is a diagrammatic view of a lamp reflector and lens system of the flashlight in accordance with a feature of the invention showing the generation of a generally rectangular cross-sectioned beam for illuminating a rectangular area.

In accordance with the present invention, the right hand end frame 50 of the flashlight 10 is adapted to support and contain a lens 70 having a shape of a chordal segment of a cylinder for generating the beam having a generally rectangular cross-sectional shape 16 as illustrated in FIG. 6 when the lamp 22 is energized. Referring particularly to FIG. 6, the chordal cylindrical lens segment 70 includes a flat inner face comprising a chordal plane and the outer surface of the lens comprises a segment of a cylinder or a Fresnel type lens having the same optical properties. The lens 70 is oriented with its length aligned on a vertical axis at right angles to the generally horizontal axis of a rectangular pattern 16 formed by the beam 14.

The reflector 26 includes a generally rectangular outer peripheral edge 72 which fits against or closely adjacent to the flat inner face of the cylindrical beam forming lens 70 and the assembled pair is inserted together into the flashlight body as shown in FIG. 5 (arrow "B"). As illustrated in FIGS. 4 and 6, the outwardly facing concave surface of the reflector 26 transitions from a circular shaped center opening 74 around the bulb 22 to a generally rectangular shaped peripheral outer edge 72 abutting the inner flat face of the lens 70. The combination of the reflective surface of the reflector 26 and the lens 70 generates the area illuminating beam 14 which illuminates a relatively large, generally rectangular area 16 at right angles to the longitudinal axis of the vertically extending lens 70.

As best shown in FIGS. 3, 5 and 6, the lamps 22 and 24 include an annular metal flange 76 between a cylindrical, electrically conductive base 78 and the glass envelope thereof. A conductive coil spring 80 of helical configuration is mounted in coaxial alignment around each lamp base 78 to bias the flange 76 of the bulb outwardly toward the respective reflector 26 and the flange 76 bears against a rearwardly facing annular recess 82 formed on the back side of the reflector around the central opening 30. Each lamp base 78 is supported in a circular aperture provided in an integrally formed, channel-shaped cross member 84 extending between opposite side walls 44 of the central section 40 of the flashlight body and the inner end coil of the spring 80 bears against an outwardly facing annular wall segment of the member 84. The springs 80 are compressed to bias the flanges 76 of the lamp bulbs 22 and 24 outwardly until the flanges engage the walls of the annular recesses 82 of the respective reflectors 26 and 28. The coil springs 80 also act as conductors for carrying current between the conductive lamp bases 78 and the circuitry generally indicated as 32 which will be described in some detail hereinafter.

When the reflector 26, lamp bulb 22, the lens 70 and the right hand end wall frame 50 is moved inwardly in the direction of arrows "B" in FIG. 5 until the lamp is firmly seated as shown in FIG. 3, electrical connection between the lamp base 78 and the spring 80 is established and the lamp 22 is firmly seated in position centered coaxially within the aperture 74 of the reflector 26 in front of the flat, back side of the cylindrical lens 70. Subsequently, when the lamp 22 is energized, the light beam 14 is established and illuminates a generally rectangular area with a lower intensity overall per unit area than the light intensity provided by the circular beam 12 when the second lamp 24 is illuminated at the opposite end of the flashlight body.

The spotlight beam 12 has a generally oval or circular shaped transverse cross-section and the flashlight 10 functions as a spotlight when the rear (left hand as viewed in the drawing) lamp 24 is energized. The light generated from the lamp bulb 24 is directed outwardly and is also reflected outwardly by the concave, outwardly facing surface of the second reflector 28. Instead of a Fresnel type lens or a cylindrical lens 70 as provided on the forward or right hand end of the flashlight (as viewed in FIG. 5), the second reflector 28 is merely provided with a transparent, flat, cover sheet 86 which is pressed against the inner surface of the outer wall of the (left hand) rear end wall frame 52. When the cover plate 86, the reflector 28, the lens bulb 24 and the spring 80 are assembled together and moved inwardly as indicated by the arrow "B" in FIG. 5, the second lamp 24 is firmly seated as illustrated and the end frame 52 is snapped into place. Electrical contact is established between the lamp base 78 and the compressed coil spring 80 in contact with the flange 76 of the lamp 24.

In accordance with the present invention, the electrical circuitry 32 of the flashlight 10 includes a negative terminal 88 adapted to make contact with the negative end of a battery 30 when the battery is inserted in place. The negative terminal 88 is interconnected to a Y-shaped switch element 89 of a two-way switch 90 positioned adjacent the upper wall 42 and activated by movement of the carrying handle 36 as will be described. Electrical interconnection between the battery terminal 88 and the switch element 89 is provided by a short lead wire 92 as illustrated in FIGS. 3 and 5. The positive terminal of the battery 30 is connected by a terminal 94 and a lead wire 96 to the central portion of a V-shaped spring contact 98 having a pair of outwardly deflectable legs that are biased into contact with the central base terminals 100 on the respective lamps 22 and 24. The V-shaped spring contact 98 is staked onto an integrally formed support pin 102 formed on the side walls 44 of the central body section 40. Similarly, a U-shaped central portion of the Y-shaped contact element 89 is staked onto an integral support pin 104 provided on the side walls 44 of the body case 20.

In accordance with the present invention, the two-way switch 90 is adapted to be actuated by the carrying handle 36. The switch 90 includes left and right hand stationary contact members 106 and 108, respectively, electrically interconnected to the springs 80 on the respective lamps 22 and 24. Each L-shaped contact 106 and 108 includes an upper leg extending parallel of the top wall 42 of the case 20 and is adapted to contact a V-shaped outer end portion one leg of the Y-shaped contact element 89. The Y-shaped contact element includes a right hand leg 110 adapted to make and break contact with the member 106 and a left hand leg 112 adapted to make and break contact with the contact member 108 as illustrated in FIGS. 3 and 5.

At the inner end, each leg 110 and 112 is provided with a U-shaped detent 114 adapted to receive and retain a depending V-shaped central portion 116 of a slidable switch operator 120 which is activated by movement of the carrying handle 36 when the handle is pivoted into an upstanding position as shown in FIGS. 3, 4 and 5. The slidable switch operator 120 includes right and left coaxially aligned leg portions 122 and 124 disposed for longitudinal sliding movement in a passage 126 formed in the relatively thick upper wall 42 of the central body section 40. The passage 126 includes an enlarged central portion 128 opening onto the interior of the body 20 below the top wall 42. The V-shaped central portion 116 of the switch operator 120 is accommodated in the opening 128 and opposite ends thereof provide stops for limiting the travel of the switch operator between a central, neutral position (N) as shown in FIG. 5, and a rear position (R) (FIG. 3), or a forward position (F) wherein the lower portion of the V-shaped central segment 116 is engaged within the detent 114 in the right hand leg 110 of the switch element 89 to make contact between the leg and the stationary contact member 106 thereby energizing the forward lamp 22 to produce a rectangular beam pattern 16 through the lens 70 at the forward end of the flashlight body 20.

Movement of the upstanding handle 36 forwardly or rearwardly out of the neutral position (N) is effective to move the switch operator 120 out of the neutral position of FIG. 5 where neither lamp is energized to a selected operating position for energizing either of the lamps 22 and 24. When in a lamp energizing position, the central detent portion 116 is retained and seated in a detent 114 of one of the legs 110 or 112. Thus, by sliding the handle 36 in a forward direction (F) relative to the flashlight body 20, the rectangular beam forming lamp 22 is energized, while sliding the handle 36 rearwardly (R) from the neutral position causes the rearwardly facing lamp 22 producing the high intensity, round or oval-shaped beam 12 to be generated by the energization of the lamp 24.

In order to move the switch operator 120 longitudinally in the passage 126 between the rearward, neutral and forward positions, the bail shaped carrying handle 36 includes a forward pivot pin 130 and a rearward pivot pin 132 which are coaxially aligned in the elongated passage 126 in which the legs 122 and 124 of the switch operator 120 are slidably disposed. The pivot pins 130 and 132 are integrally joined at the ends of front and rear cover legs 134 and 136, respectively, of the carrying handle 36. The legs 134 and 136 are, in turn, integrally joined to a bight portion 138 of the handle 36 extending parallel of the upper wall 42 of the case body 20.

The handle 36 is pivotable in either direction about the coaxial pivots 130 and 132, out of a closed or "off" position as shown in FIGS. 1 and 2 wherein the bight portion 138 is parallel and adjacent to the bottom of the case 20 to an upstanding "on" or carrying position as shown in FIGS. 3, 4 and 5, wherein both the lens 70 and the cover plate 86 are exposed for permitting light passage outwardly when the switch 90 is subsequently activated to energize either of the lamps 22 or 24.

The forward leg 134 and the rearward leg 136 thus serve a dual function in covering and protecting the lenses, lamps and reflectors when closed as shown in FIGS. 1 and 2 and, in addition, provide an ample spacing between the bight portion 138 of the bail shaped handle 36 and the top wall 42 of the flashlight body 40 to accommodate the finger or fingers of a person carrying the flashlight while in use. A handicapped or arthritic crippled person can readily energize the lamp of the flashlight 10 by movement of the handle toward the open position as shown in FIG. 3, wherein the flashlight is easily carried on a bent or crippled finger or fingers of a handicapped user because of the ample open space between the bight portion 138 and the case 20 of the flashlight. Preferably, the carrying handle 36 including pivot pins 130 and 132, the legs 134 and 136 and the bight 138 are integrally formed and are somewhat flexible.

Once the handle 36 is pivoted out of the closed position (FIGS. 1 and 2) wherein the lens 70 and plate 86 are covered, a selected lamp 22 or 24 may be turned on by movement of the upstanding handle 36 in a forward (F) or rearward (R) direction thereby moving the V-shaped central portion 116 of the switch operator 120 into the detent 114 of a selected contact leg 110 or 112.

In order to freely permit such handle movement yet limit the travel thereof, the forward and rearward end surfaces of the relatively thick upper wall portion 42 of the body case 40 are formed with beveled cam surfaces 140 and these surfaces when engaged by inner surfaces of the legs 134 and 136 of the handle tend to displace the handle back to the neutral (N) position as the handle is folded up or pivoted toward the closed or off position of FIGS. 1 and 2 wherein the bight 138 underlies the lower end or bottom wall of the body 20.

The case 20 includes a pair of rounded feet 142 on each half of the body section 40 for supporting the flashlight 10 in an upstanding position on a table or other surface when the handle 36 is in the upstanding or on position. When the handle 36 is folded up to the closed or off position, the feet 142 engage opposite sides of the handle bight 138 and normally retain the handle 36 in the off position so that the compact flashlight can be handily carried in a user's pocket and will not slip out of the off position and turn on the lamp inadvertently as the user moves about.

It will thus be seen that movement of the handle 36 in a longitudinal direction is effective to energize either of the lamp bulbs 20 or 24 once the handle is in an upstanding position as shown in FIGS. 3 through 5, whereas pivotal movement of the handle 36 in either direction away from the upstanding position back downwardly towards the folded up, closed or off position of FIGS. 1 and 2 is effective to turn off either of the selected lamps 22 or 24 because the cam surfaces 140 act to move the handle longitudinally relative to the body 40 and thereby position the switch operator 120 in a neutral (N) position as shown in FIG. 5 wherein the central segment 116 is centered above the stake 104.

Figure 7:
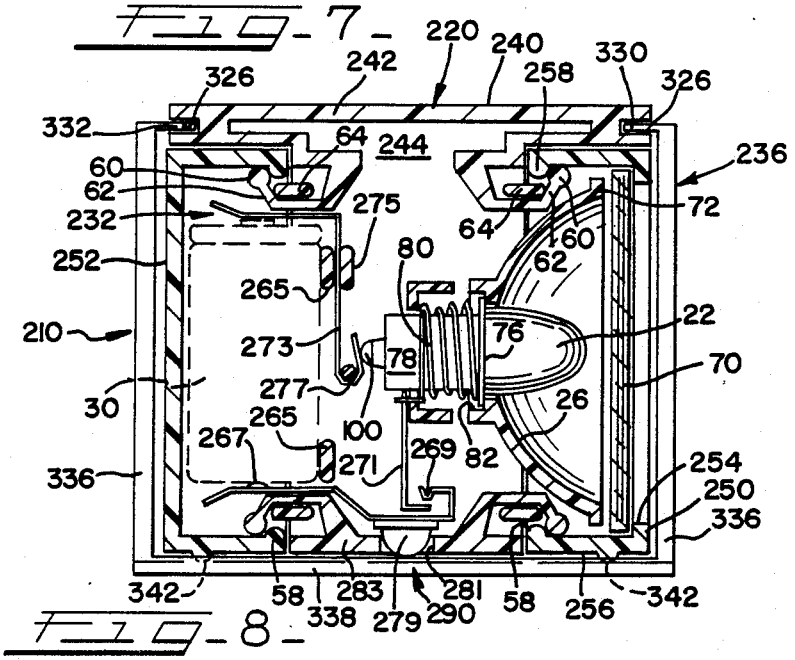
Figure 8:
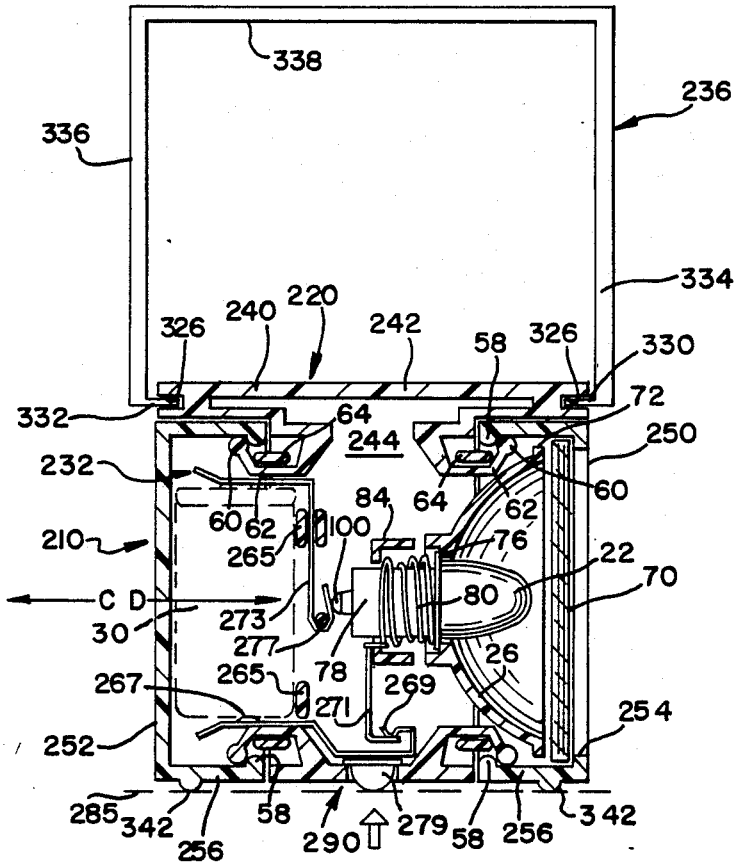
FIG. 8 is a similar longitudinal crosssectional elevational view of the flashlight of FIG. 7 but illustrating the carrying handle thereof in an upwardly extending, "on" or operative position for energizing the lamp to produce a generally rectangular shaped beam.

Referring now to FIGS. 7 and 8, therein is illustrated another embodiment of a flashlight constructed in accordance with the features of the present invention and referred to generally by the reference numeral 210. The flashlight 210 employs a number of components which are similar or identical to those utilized in the first embodiment of FIGS. 1 through 6 and the flashlight 210 is adapted to provide only a single beam for illuminating a generally rectangular shaped area 16 by means of a Fresnel type or cylindrical lens 70 located at one end of a flashlight body or case 220. Identical components in both embodiments will utilize identical reference numerals and components in the second embodiment of FIGS. 7 and 8 similar to those of the first embodiment will have reference numerals 200 higher than those used for their counterparts in the first embodiment of FIGS. 1 through 6. Moreover, only the significant differences in the two embodiments will be described in detail.

The flashlight 210 differs from the flashlight 10 in that only a single function is provided and a battery 30 is stored within the case 220 in a different location than in the flashlight 10 previously described. The flashlight 210 employs a similar bail type carrying handle 236 having a bight portion 338, a forward leg 334 and a rearward leg 336 pivoted on respective pivot pins 330 and 332 extending into recesses 326 formed in forward and rearward ends of a relatively thick upper wall 242 of a flashlight body midsection 240.

The midsection includes opposed, spaced apart, side walls 244 and a snap-in front end frame or end wall 250 similar to the frame 50 of the prior embodiment. The frame 250 supports a cylindrical lens 70, a reflector 26 and a lamp 22 as in the previous embodiment. The only difference between the front end frame 250 and the frame 50 of the previous embodiment is the fact that the upper end portion of the frame 250 does not require a sloping cam face for interaction with the front leg 334 of the carrying handle 236.

The body or case 220 of the flashlight 210 includes a main central section 240 having opposite side walls 244 and is formed in two halves joined together. The central section 240 also has cross bars 64 identical to those of the prior embodiment and includes retaining ribs 60 on the outer ends of flexible fingers 62 adapted to snappingly engage and hold in place the forward end frame 250 and a modified, rear end frame 252 which does not provide a rectangular opening 254 like that of the frame 250 because of the absence of a second rearwardly facing lamp bulb. The modified, rear end wall 252 also does not require a beveled upper end surface but does include ribs 58 for snappingly engaging the retainer ribs 60 on the fingers 62 of a central body section 240.

The rearward end wall 252 is readily removable by outward pull in the direction of arrow "C" for insertion or replacement of a battery 30 which is insertable into the case 220 by movement of the rearward end wall 252 and the battery 30 in the direction of an arrow "D", longitudinally aligned with the central axis of the forwardly facing lamp bulb 22. The battery 30 is contained within a space defined in the rearward section of the case or housing 220 by a pair of cross members 265 joining opposite side walls 244 of the central housing section 240. In addition, a negative terminal, spring contact member 267 is provided to make electrical contact with the negative end of the battery 30 when inserted, and the spring member 267 has a forward end portion 269 with a V-shaped segment adapted to make and break contact with an L-shaped contact member 271 electrically connected to the lamp base 78 via the coil spring 80 mounted around the lamp base for biasing the lamp towards the reflector 26 as previously described.

The remaining portion of a modified electrical circuit 232 of the flashlight 210 comprises a positive terminal element 273 of generally L-shaped configuration having a rearwardly facing leg adapted to engage the positive terminal of the battery 30 when inserted. The terminal member 273 includes a downwardly extending leg portion sandwiched between a cross member 265 and another cross member 275 for holding the member in place. A lower end of the contact member 273 is of U-shaped design and curls around another cross member 277 for biasing an upwardly extending, relatively short leg portion into electrical contact against the central terminal end 100 of the lamp 22.

The flashlight 210 includes a switching system 290 employing the forward end portion 269 of the negative battery terminal contact 267 and a lower leg of the stationary terminal 271 connected to the lamp spring 80. When the carrying handle 236 is folded into a closed position with the front leg 334 in covering position over the lens 70, the inside surface of a bight portion 338 of the handle engages a button like operator 279 which is mounted in an aperture 281 formed in a fixed bottom wall 283 of the case. The button 279 includes a disc at the upper end which engages a forward end portion of the negative battery terminal contact 267 to remove the contact segment 269 upwardly away from contact with the contact member 271 to break the electrical connection between the battery and the lamp whenever the handle is closed as illustrated in FIG. 7.

When the handle is opened and moved upright to the "on" or operating position as shown in FIG. 8, however, the bight portion 338 of the handle 236 moves away from the operator button 279 and the spring bias of the contact member 267 forces the contact portion 269 downwardly to make electrical contact with the L-shaped contact member 271 and energizes the lamp 222 to generate a rectangular-shaped, illuminated area from the low intensity beam 14. The return of the handle 236 to the lens covering, closed or "off" position (as shown in FIG. 7) again breaks contact between the contact members 269 and 271 to turn off the lamp 22 automatically. The handle is normally retained in the closed position by engagement of small feet 342 with opposite edges of the bight portion 338 of the handle in a manner like that shown in FIG. 2 wherein the support feet 142 hold the handle 36 in place. These feet 342 support the flashlight in a steady upright position on a table surface 285 with the handle 36 in an upstanding "on" position to energize the lamp 22.

In summary, the flashlight 210 provides only a single lamp 22 and a chordal, segmented cylindrical or Fresnel type lens 70 and does not provide a dual purpose function like the flashlight 10 of the previous embodiment. A reflector 28 and a lamp cover 86 like that of the flashlight 10 can be substituted for the lens 70 and reflector 28 should it be desired to provide a spotlight type single function flashlight 210 instead of a single function area illumination beam 14.

Although the present invention has been described in terms of two preferred embodiments, it is intended to include those equivalent structures, some of which may be apparent upon reading this description, and others that may be obvious after study and review.

What is claimed and sought to be secured by Letters Patent of the United States is:

1. A battery powered flashlight, comprising:

a case holding a battery, a lamp, a reflector for said lamp and an electric circuit including switch means for connecting and disconnecting said battery to selectively energize and turn off said lamp; and lens means supported in said case in front of said lamp and said reflector for forming a beam of light when said lamp is illuminated projecting outwardly of said case, said lens means having an essentially flat inside face in front of said reflector and lamp and a convex outer surface comprising a segment of a cylinder forming said beam to illuminate a generally rectangular area when said end of said case is pointed toward the same.

2. The battery powered flashlight of claim 1, including:

a carrying handle pivotally secured to said case and movable between a first position covering said lens means and a second position for carrying said flashlight and uncovering said lens means.

3. The battery powered flashlight of claim 2, including:

operator means actuable to close said switch means to energize said lamp when said carrying handle is moved toward said second position.

4. The battery powered flashlight of claim 2, including:

operator means actuable to open said switch means to turn off said lamp when said carrying handle is moved into said first position.

5. The battery powered flashlight of claim 3, wherein:

said operator means includes a button portion extending out of said case and engageable by said carrying handle while in said first position to turn off said lamp and operable to turn on said lamp when said handle is in said second position.

6. The battery powered flashlight of claim 1, wherein:

said lamp has a central axis of symmetry and is centered in said reflector, said reflector and said lens means each having a generally rectangular shaped periphery adjacent one another and said end of said case with a transverse dimension substantially less than a length normally extending in an upright direction when said flashlight is carried by said handle.

7. The battery powered flashlight of claim 6, wherein:

said cylindrical segment comprising said convex outer surface of said lens means has a chord defined on said flat inside face transversely of said length thereof whereby said illuminated rectangular area provided by said beam extends at right angles to said length of said lens means.

8. The battery powered flashlight of claim 2, including:

a second lamp and a second reflector in said case adjacent an opposite end thereof, said electric circuit including second switch means for connecting and disconnecting said battery to selectively illuminate and turn off said second lamp.

9. The battery powered flashlight of claim 8, including:

means for selecting between said first mentioned lamp and said second lamp actuated by said handle while in said second position to turn on one or the other of said lamps.

10. The battery powered flashlight of claim 9, wherein:

said second lamp and second reflector form a beam for spot illumination extending outwardly of said opposite end of said case when said second lamp is turned on with said handle in said second position.

11. A battery powered flashlight comprising:

a case holding a battery, a lamp, a reflector for said lamp, and an electrical circuit including switch means for connecting and disconnecting said battery to selectively turn on and turn off said lamp; and a carrying handle pivotally mounted on said case for movement between a first position covering said lamp and reflector and a second position for carrying said flashlight and uncovering said lamp and reflector.

12. The battery powered flashlight of claim 11, including:

a second lamp and reflector for directing a second beam of light when turned on extending outwardly of said case in a direction away from a first beam of light established by said first mentioned lamp when said carrying handle is pivoted out of said first position, in which said first position said second lamp and reflector is also covered by said handle.

13. The battery powered flashlight of claim 12, wherein:

said switch means is connected in said circuit for alternately turning on said first mentioned lamp and said second lamp; and said carrying handle is movable between alternate locations which in said second position for selectively actuating said switch means to energize one or the other of said first mentioned lamp and said second lamp.

14. The battery powered flashlight of claim 13, wherein:

said carrying handle is movable to and from said alternate locations from a central location while in said second position wherein neither of said lamps is illuminated.

15. The battery powered flashlight of claim 11, wherein:

said switch means includes means responsive to movement of said handle from said first position toward said second position for turning on said lamp.

16. The battery powered flashlight of claim 12, wherein:

said switch means includes means responsive to movement of said handle from said first position toward alternate locations of said second position for turning on a selected one of said lamps.

17. The battery powered flashlight of claim 16, wherein:

said switch means includes detent means for retaining said handle in a selected one of said alternate locations while in said second position.

18. The battery powered flashlight of claim 17, including:

detent means for retaining said handle in a neutral location while in said second position for turning on neither one of said lamps.

19. The battery powered flashlight of claim 12, wherein:

said carrying handle comprises a generally U-shaped member having a pair of legs and a bight joined to inner ends of said legs, each of said legs pivotally secured adjacent an outer end to an end of said case and covering a lamp and reflector when said handle is in said first position wherein said bight is adjacent a bottom of said case which extends between lower edges of said ends.

20. The battery powered flashlight of claim 19, including:

means for normally retaining said handle in said first position and releasable to permit pivotal movement of said handle to said second position wherein said bight is spaced above a top of said case for carrying said flashlight.

21. The battery powered flashlight of claim 20, wherein:

said retaining means includes a plurality of feet on said bottom of said case engageable with said bight to retain the bight adjacent to said bottom until said handle is pivoted toward said second position.

22. The battery powered flashlight of claim 21, wherein:

said feet comprise integrally spaced apart formed rounded elements protruding downwardly from said bottom and engageable adjacent opposite edges of said bight when said handle is in said first position; and when said feet are positioned to support said case in an upstanding position on a supporting surface when said handle is in said second position.

23. The battery powered flashlight of claim 21, wherein:

said carrying handle comprises a generally U-shaped member having a pair of legs and a bight joined to inner ends of said legs, each of said legs pivotally secured adjacent an outer end to an end of said case and one of said legs covering said lamp and reflector when said handle is in said first position wherein said bight is adjacent a bottom of said case which extends between lower edges of said ends.

24. The battery powered flashlight of claim 23, including:

means for normally retaining said handle in said first position and releasable to permit pivotal movement of said handle to said second position wherein said bight is spaced above a top of said case for carrying said flashlight.

25. The battery powered flashlight of claim 24, wherein:

said retaining means includes a plurality of feet on said bottom of said case engageable with said bight to retain the bight adjacent to said bottom until said handle is pivoted toward said second position.

26. The battery powered flashlight of claim 25, wherein:

said feet comprise integrally spaced apart formed rounded elements protruding downwardly from said bottom and engageable adjacent opposite edges of said bight when said handle is in said first position; and when said feet are positioned to support said case in an upstanding position on a supporting surface when said handle is in said second position.

27. The battery powered flashlight of claim 1, wherein:

said lens means comprises a Fresnel type lens.

28. A flashlight, comprising:

a flashlight body containing a lamp providing a source of light approximating a point source and a reflector surrounding said lamp for directing light from said point source outwardly of said body along an axis extended from said point source when said lamp is energized; and chordal cylindrical lens means on said body extending transversely across said axis and spaced outwardly of said point source for forming said light into a beam having a generally rectangular shaped cross-section measured transversely of said axis.

* * * * *